US008612162B2

(12) United States Patent
Furuhashi et al.

(10) Patent No.: US 8,612,162 B2
(45) Date of Patent: Dec. 17, 2013

(54) MASS ANALYSIS DATA PROCESSING METHOD AND MASS SPECTROMETER

(75) Inventors: Osamu Furuhashi, Uji (JP); Kiyoshi Ogawa, Kizugawa (JP); Shigeki Kajihara, Uji (JP); Tohru Kinugawa, Osaka (JP)

(73) Assignee: Shimadzu Corporation, Kyoto-Shi (JP)

( * ) Notice: Subject to any disclaimer, the term of this patent is extended or adjusted under 35 U.S.C. 154(b) by 283 days.

(21) Appl. No.: 13/047,577

(22) Filed: Mar. 14, 2011

(65) Prior Publication Data

US 2011/0231109 A1 Sep. 22, 2011

(30) Foreign Application Priority Data

Mar. 19, 2010 (JP) ..... 2010-064328

(51) Int. Cl.
*H01J 49/00* (2006.01)
*H01J 49/26* (2006.01)
*H01J 49/40* (2006.01)

(52) U.S. Cl.
USPC ..... 702/23; 250/281; 250/282; 250/286; 250/287

(58) Field of Classification Search
USPC ..... 250/281, 282, 286, 287
See application file for complete search history.

(56) References Cited

U.S. PATENT DOCUMENTS

| | | | | |
|---|---|---|---|---|
| 7,482,583 | B2 * | 1/2009 | Ueno | 250/287 |
| 2002/0009394 | A1 * | 1/2002 | Koster et al. | 422/65 |
| 2005/0077462 | A1 * | 4/2005 | Yamaguchi et al. | 250/287 |
| 2005/0092913 | A1 * | 5/2005 | Ishihara | 250/287 |
| 2005/0151076 | A1 * | 7/2005 | Yamaguchi et al. | 250/291 |
| 2005/0247869 | A1 * | 11/2005 | Yamaguchi | 250/287 |
| 2008/0052011 | A1 * | 2/2008 | Wang et al. | 702/27 |
| 2008/0061226 | A1 * | 3/2008 | Satoh | 250/287 |
| 2010/0258716 | A1 * | 10/2010 | Yamaguchi | 250/287 |
| 2010/0282965 | A1 * | 11/2010 | Nishiguchi et al. | 250/282 |

FOREIGN PATENT DOCUMENTS

| | | |
|---|---|---|
| JP | 2005-079049 | 3/2005 |
| JP | 2005-116343 | 4/2005 |
| WO | 2008/107931 A1 | 9/2008 |

(Continued)

OTHER PUBLICATIONS

Masaru Nishiguchi et al., "Design of a new multi-turn ion optical system 'IRIS' for a time-of-flight mass spectrometer", Journal of Mass Spectrometry, 2009, vol. 44, pp. 594-604.
Masaru Nishiguchi et al., "Novel Multi-Turn Mass Spectrometry with Multi-Turn Ion Optical Systems", Shimadzu Review, vol. 66, Nos. 1 and 2, Sep. 30, 2009, pp. 61-72.
Japanese Office Action mailed Jul. 30, 2013 for corresponding Japanese Patent Application No. 2010-064328.

(Continued)

*Primary Examiner* — Andrew Schechter
*Assistant Examiner* — John Kuan
(74) *Attorney, Agent, or Firm* — Bingham McCutchen LLP

(57) ABSTRACT

A method creates an accurate mass spectrum with a high resolving power based on a plurality of TOF spectra, while reducing the computation to assure real-time processing. TOF spectra are measured when ions are ejected from the loop orbit. Then a coincidence detection method determines what mass-to-charge ratio a peak appearing on the TOF spectra originates from. The time range in which a corresponding peak appears on other TOF spectra is set, and the existence of the peak in that range is determined. When the corresponding peak is found on other TOF spectra, the m/z is deduced from the peak on the TOF spectrum with the highest resolving power and a mass spectrum is created. From the peak density around the peak of interest, the reliability of the deduction is computed. For a low reliability peak, the ion ejection time is optimized and the TOF spectrum is measured again.

9 Claims, 6 Drawing Sheets

(56) References Cited

FOREIGN PATENT DOCUMENTS

| | | | | |
|---|---|---|---|---|
| WO | WO 2009/066354 | * | 5/2009 | ..... H01J 49/40 |
| WO | WO 2009/075011 | * | 6/2009 | ..... G01N 27/62 |
| WO | WO 2009/075011 A1 | | 6/2009 | |

OTHER PUBLICATIONS

English translation of Reason for Rejection in Japanse Office Action mailed Jul. 30, 2013 for corresponding Japanese Patent Application No. 2010-064328.

* cited by examiner

PROBABILITY OF ACCIDENTAL COINCIDENCE $$P_i = \frac{\Delta T}{\min(T_1, T_2)}$$

MASS ANALYSIS DATA PROCESSING METHOD AND MASS SPECTROMETER

The present invention relates to a multi-turn time-of-flight mass spectrometer in which ions originating from a sample are made to fly along a closed loop orbit repeatedly multiple times to separate them in accordance with their mass-to-charge ratio (m/z). It also relates to a mass analysis data processing method for processing the data collected by the mass spectrometer.

BACKGROUND OF THE INVENTION

Time-of-Flight Mass Spectrometer (which will hereinafter be referred to as TOFMS) is a type of device that creates a mass spectrum by measuring the time of flight required for each ion to travel a specific distance and converting the time of flight to the mass-to-charge ratio. This analysis is based on the principle that ions accelerated by a certain amount of energy will fly at different speeds corresponding to their mass. Accordingly, elongating the flight distance of ions is effective for enhancing the mass resolving power. However, elongation of a flight distance along a straight line requires unavoidable enlargement of the device. Given this factor, Multi-Turn Time-of-Flight Mass Spectrometers (which will hereinafter be referred to as MT-TOFMS) have been developed in which ions are made to fly repeatedly along a closed orbit such as a substantially circular shape, substantially elliptical shape, substantially "8" figure shape, or other shapes, in order to simultaneously ensure a long flight distance and achieve the downsizing of the apparatus.

Another type of device developed for the same purpose is the multi-reflection time-of-flight mass analyzer, in which the aforementioned loop orbit is replaced by a reciprocative path in which a reflecting electric field is created to make ions fly back and forth multiple times. Although the multi-turn time-of-flight type and the multi-reflection time-of-flight type use different ion optical systems, they are essentially based on the same principle for improving the mass resolving power and have a common problem, which will be described later. Accordingly, in the context of the present description, the "multi-turn time-of-flight type" should be interpreted as inclusive of the "multi-reflection time-of-flight type".

As previously described, an MT-TOFMS can provide an elongated flight distance and thereby achieve a high level of mass resolving power. However, it has a drawback due to the fact that the flight path of the ions is a closed orbit. That is, as the number of turns of the ions increases, an ion having a smaller mass-to-charge ratio and hence flying faster overtakes another ion having a larger mass-to-charge ratio and flying at a lower speed. Such an overtaking of the ions having different mass-to-charge ratios results in, on an obtained time-of-flight spectrum, a mixture of peaks originating from the ions having undergone different number of turns. This means it is no longer ensured that the mass-to-charge ratio and the time of flight uniquely correspond In this case, it is impossible to uniquely determine the mass-to-charge ratio of the ions and also their flight distance, so that the time-of-flight spectrum cannot be directly converted to a mass spectrum.

Because of the aforementioned problem, in many conventional MT-TOFMSs, ions are selected in advance (i.e. before they are introduced into the loop orbit) among the ions that originate from a sample generated in an ion source so that their mass-to-charge ratio is assuredly limited to a range where the aforementioned overtaking will not occur. Although a high mass resolving power can be achieved with such a method, the range of the mass spectrum is significantly limited. This is against the advantage of TOFMSs that a mass spectrum with a relatively large mass-to-charge ratio range can be obtained by one measurement.

In the meantime, some methods have been proposed to date for creating a correct mass spectrum from a time-of-flight spectrum obtained by a measurement even in a case where the overtaking of ions occurs while they fly along the orbit, as hereinafter described.

For example, JP-A 2005-79049 (Patent Document 1) discloses a method in which a plurality of time-of-flight spectra for different periods of time of ejection of the ions from the orbit are measured for a target sample and then a time-of-flight spectrum of a single turn is reconstructed using a multi-correlation function of the plural different time-of-flight spectra. The "period of time of ejection of an ion" is generally the amount of time from the point in time when the ion is ejected from an ion source until the point in time when the ion is made to deviate from the loop orbit after passing through this orbit. Hereinafter, this will be simply referred to as the "ion ejection time." With this method, obtaining a mass spectrum substantially in real time while performing a measurement is almost impossible because of the large amount of computation of the multi-correlation function, which requires a considerable computing time. Further, if the number of peaks appearing on the time-of-flight spectra is significantly large, the amount of computation becomes enormous. In such a case, it is difficult to obtain a result in a practically acceptable length of time if a general-purpose personal computer is used.

Another method for obtaining a mass spectrum is described in WO 2009/075011 (Patent Document 3), Nishiguchi, et al. "Taju Shukai Ion Kougakukei Niyoru Atarashii Taju Shukai Shitsruryo Bunseki Hou," ("Novel Multi-Turn Mass Spectrometry with Multi-Turn Ion Optical Systems") *Shimadzu Review*, vol. 66, Nos. 1 and 2, published on Sep. 30, 2009, and Nishiguchi, et al. "Design of a new multi-turn ion optical system 'IRIS' for a time-of-flight mass spectrometer," *J. Mass Spectrum.,* 44 (2009), p. 594. In this method, a time-of-flight spectrum (zero-turn time-of-flight spectrum) for a target sample is obtained in a linear mode in which ions injected into the apparatus are ejected without closed loop orbit. Then, the number of turns and the time of flight in a multi-turn mode, in which an ion may overtake another ion, are predicted from the time-of-flight of the peaks on the zero-turn time-of-flight spectrum. After that, based on this prediction, time-of-flight segments, whose widths are determined by considering the time spread of peaks, are set on the time-of-flight spectrum in the multi-turn mode. Since peaks included in one segment originate from ions with the same number of turns, the number of turns and the mass-to-charge ratio of all the peaks can be uniquely determined unless the adjacent segments do not overlap each other. Hence, the existence of the overlapping of the segments, which are set on the time-of-flight spectrum in the multi-turn mode, is judged to search for a condition under which the overlapping does not occur and to fix the segment setting. Since this determines the optimum ejection time when ions should be ejected from the loop orbit, a measurement in the multi-turn mode is performed by controlling the timing for switching the gate electrode for ejecting ions based on this optimum ejection time. Then, a mass spectrum is obtained from the time-of-flight spectrum obtained as a result of this measurement.

In this method, the data processing is relatively simple, allowing a general-purpose personal computer to perform the processing substantially in real time. However, this method is disadvantageous in that the mass spectrum cannot be created in the case where the number of peaks to be observed is so large that no condition to avoid the overlapping of the segments can be found. When the sample to be measured is a protein, sugar chain or similar substance, it is anticipated that the segments often overlap. Accordingly, the cases to which this method can be applied are significantly limited. Limiting the range of mass-to-charge ratio of the ions introduced into the loop orbit may be another approach to prevent the segments from overlapping. However, this disadvantageously deteriorates the measurement throughput.

JP-A 2005-116343 (Patent Document 2) discloses a method for deducing the mass-to-charge ratio of a target ion by a process including the steps of: measuring a plurality of time-of-flight spectra of a target sample with different ion ejection times; calculating possible candidates for the mass-to-charge ratio of the target ion by assuming number of turns for each peaks on each of the plurality of time-of-flight spectra; and locating a candidate of the mass-to-charge ratio that has been commonly selected on all of the plurality of time-of-flight spectra.

Also in this method, the required data processing is relatively simple and the processing can be performed substantially in real time with a general-purpose personal computer. Finding the relationship of the peaks between the different time-of-flight spectra is easy for a small number of peaks. However, this relating process becomes complicated when the number of components contained in the sample is large and the number of peaks appearing on the time-of-flight spectra is accordingly large. In addition, if the number of peaks is large, an erroneous deduction of the mass-to-charge ratio could accidentally occur with a higher probability. Further, the peaks originating from ions having different mass-to-charge ratios become more likely to accidentally overlap each other on a time-of-flight spectrum, which prevents accurate deduction of the mass-to-charge ratio.

SUMMARY OF THE INVENTION

As previously described, each of the conventional methods for constructing a mass spectrum from time-of-flight spectrum data obtained with an MT-TOFMS has both advantages and disadvantages.

All the aforementioned methods, except for the method described in Patent Document 3, rely on some sort of deduction from a time-of-flight spectrum or spectra to obtain a mass spectrum. However, it is difficult to evaluate the reliability of the deduction result, and in fact, the necessity of such an evaluation has been hardly taken into consideration. Since the reliability of the deduction result is not quantified, it is difficult to adaptively control the measurement in accordance with the reliability, e.g. halting the measurement even in the middle of it when a sufficiently reliable result has been obtained, or inversely, starting over again the measurement when only an unreliable result has been obtained. This fact makes it difficult to enhance the throughput and prevent a wasteful consumption of a sample.

To create an accurate mass spectrum, the intensity information of each ion is important as well as their mass-to-charge ratio. The conventional methods are primarily focused on the determination of the mass-to-charge ratio (or the number of turns) of the observed peaks, while the acquisition of accurate intensity information of the peaks is not taken into consideration much or sufficiently. Especially, in the case where peaks accidentally overlap on a time-of-flight spectrum, the occurrence of the overlapping cannot be accurately recognized, so that it is difficult to separate the overlapping peaks to obtain their intensity information.

In an MT-TOMS, a gate electrode is used to eject ions from the loop orbit. Due to the fact that this gate electrode has a certain amount of size and the time required for changing the electric field is not negligible, an ion or ions, which are inside the gate electrode when the voltage applied to the gate electrode is switched to start the ejection of ions from the loop orbit, vanish. That is, some part of the ions inevitably disappears when they are ejected from the loop orbit. Such ions will not appear on the time-of-flight spectrum. In the following description, the disappearance of an ion due to such a reason is referred to as the "ion disappearance caused by hiding in the shadow of the gate electrode". With the methods described in Patent documents 1 and 2, it is difficult to reflect into the deduction result the effect of the ion disappearance caused by hiding in the shadow of the gate electrode.

The method described in Patent Document 3 seems to leave open a possibility of avoiding the effect of the ion disappearance caused by hiding in the shadow of the gate electrode. However, in an MT-TOFMS, in addition to the ion disappearance caused by hiding in the shadow of the gate electrode, an ion may unpredictably disappear or a noise peak may appear due to the mixture of an electric noise or other reasons. In any conventional method, such unpredictable situations are not taken into consideration. Hence, if any of these happens, it is difficult to obtain an accurate result.

The present invention has been developed in view of the aforementioned problems and the main objective thereof is to provide a mass analysis data processing method and a mass spectrometer capable of obtaining an accurate mass spectrum over a wide range of mass-to-charge ratio by performing a relatively simple real-time processing of data collected by an MT-TOFMS, and also capable of quantitatively obtaining the reliability of the result obtained by such a data processing.

To solve the previously described problems, the first aspect of the present invention provides a mass analysis data processing method for processing data collected by a multi-turn time-of-flight mass spectrometer having: an ion source for ejecting ions to be analyzed in a pulsed fashion; a loop orbit unit for making ions ejected from the ion source fly multiple times along a substantially same orbit; and a detector for detecting ions which have flown in the loop orbit unit, and for creating a mass spectrum based on a plurality of time-of-flight spectra of a same sample obtained by changing, in stages, a timing of ejecting ions from the loop orbit so as to direct the ions from the loop orbit unit to the detector, including:

a) a mass-to-charge ratio deduction step for determining a mass-to-charge ratio of an ion corresponding to a peak of interest on one time-of-flight spectrum selected from the aforementioned plurality of time-of-flight spectra, based on coincidence discrimination of a plurality of assumed values of the mass-to-charge ratio, wherein each coincidence discrimination is obtained by performing, for each of two or more of the aforementioned plurality of time-of-flight spectra other than the aforementioned one time-of-flight spectrum, a process including estimating flight times of the ion corresponding to the peak of interest on the time-of-flight spectrum by assuming values of the mass-to-charge ratio, and checking whether or not a peak exists at the estimated flight time on an actually obtained time-of-flight spectrum; and b) a reliability computing step for deducing, for each of the aforementioned two or more time-of-flight spectra, a probability that the coincidence in the time position of the peak of interest on the other time-of-flight spectrum accidentally occurs in the mass-to-charge ratio deduction step, and for computing a quantitative value representing a degree of reliability of the processing performed in the mass-to-charge ratio deduction step from the deduced values of the probability for the plurality of other time-of-flight spectra.

The second aspect of the present invention provides a time-of-flight mass spectrometer including: an ion source for ejecting ions to be analyzed in a pulsed fashion; a loop orbit unit for making ions ejected from the ion source fly multiple times along a substantially same orbit; a detector for detecting ions which have flown in the loop orbit unit; and a data processor for creating a mass spectrum based on a plurality of time-of-flight spectra of a same sample obtained by changing, in stages, a timing of ejecting ions from the loop orbit so as to direct the ions from the loop orbit unit to the detector, wherein the data processor includes:

a) a mass-to-charge ratio deduction means for determining a mass-to-charge ratio of an ion corresponding to a peak of interest on one time-of-flight spectrum selected from the aforementioned plurality of time-of-flight spectra, based on coincidence discrimination of a plurality of assumed values of the mass-to-charge ratio, wherein each coincidence discrimination is obtained by performing, for each of two or more of the aforementioned plurality of time-of-flight spectra other than the aforementioned one time-of-flight spectrum, a process including estimating flight times of the ion corresponding to the peak of interest on the time-of-flight spectrum by assuming values of the mass-to-charge ratio, and checking whether or not a peak exists at the estimated flight time on an actually obtained time-of-flight spectrum; and b) a reliability computing means for deducing, for each of the aforementioned two or more time-of-flight spectra, a probability that the coincidence in the time position of the peak of interest on the other time-of-flight spectrum accidentally occurs in the process performed by the mass-to-charge ratio deduction means, and for computing a quantitative value representing a degree of reliability of the processing performed in the mass-to-charge ratio deduction step from the deduced values of the probability for the plurality of other time-of-flight spectra.

In the mass analysis data processing method according to the first aspect of the present invention and the mass spectrometer according to the second aspect of the present invention, the timing when ions are ejected from the loop orbit in the MT-TOFMS is changed in a plurality of steps to obtain a plurality of time-of-flight spectra. Then, the concept of the coincidence detection method, which is frequently used in the field of radiation measurement, is used to assign the peaks (i.e. deduce the kind or mass-to-charge ratio of the ions from which the peaks have originated) appearing on the plurality of time-of-flight spectra. In a general coincidence detection method, the temporal coincidence of the generation of signals is judged. However, in the first and second aspects of the present invention, with respect to a peak of interest on a certain time-of-flight spectrum, the coincidence is judged, for example, between the position (or the time of flight) on the time axis of the other time-of-flight spectra computed by assuming mass-to-charge ratio and the position (or the time of flight) on the time axis of a time-of-flight spectrum that is obtained by an actual measurement.

If a time-of-flight spectrum is obtained for the case where the number of turns is zero, i.e. where ions are ejected from the ion source and reach the detector without passing the loop orbit, or for the case where ions reach the detector after completing one turn along the loop orbit or passing only a part of the loop orbit, one peak on the time-of-flight spectrum can indicate the approximate value of the mass-to-charge ratio. By using this value, it is possible to set a time position range, in which a peak (or peaks) corresponding to the peak on the spectrum can appear, on other time-of-flight spectra and a peak (or peaks) within this range can be regarded as a coincidence.

The coincidence detection method is characterized in that the probability of the occurrence of an erroneous detection can be reduced by extending multiple-coincidence as described later. Therefore, the reliability of the deduction can be increased by increasing the number of time-of-flight spectra obtained by measuring the same sample and accumulating the results showing the coincidence of the peaks for the plurality of time-of-flight spectra.

In the mass analysis data processing method according to the first aspect of the present invention and the mass spectrometer according to the second aspect of the present invention, deducing the time position or time position range in the other time-of-flight spectrum requires only a simple computation, and the judgment of the coincidence within the time position range is obtained merely requires a binary determination concerning the existence of a peak. Hence, the data processing is very simple and accordingly can be performed fast, which enables a substantially real-time analysis even with a general purpose personal computer.

In the mass analysis data processing method according to the first aspect of the present invention, in the reliability computing step, the probability that the accidental assignment of the peak of interest on a time-of-flight spectrum occurs may be deduced based on the information on adjacent peaks on the time axis. The "information on adjacent peaks on the time axis" can be any information that indicates the density of the peaks around the peak of interest. For example, the time difference between the peak of interest and the peak which is the closest thereto may be used as this information. The worst-case value of the probability that the assignment of the peak of interest on any one of the time-of-flight spectra is determined to be accidental, i.e. that the coincidence is an erroneous one, can be obtained from the aforementioned time difference and the peak width of the peak of interest, for example. Hence, the reliability of the deduction result for an assumed value of the mass-to-charge ratio of a peak of interest can be expressed as the inverse of the product of the probabilities that the assignment of the peak of interest in each of the plurality of time-of-flight spectra is accidental.

As the number of peaks increases, the density of the peaks around the peak of interest naturally increases. Accordingly, this increases the probability of accidental assignment of the peak of interest on a time-of-flight spectrum, i.e. the probability of an erroneous coincidence. In such a case, since the reliability obtained in the reliability computing step deteriorates, an analysis operator can recognize that the reliability of the deduction result is low and take appropriate measures to increase the reliability, such as increasing the number of time-of-flight spectra to be measured. That is, in the mass analysis data processing method according to the first aspect of the present invention, it is preferable to check the reliability obtained in the reliability computing step, and correct the timing for ejecting ions from the loop orbit if the reliability is low. Such a remeasurement can be automatically performed, or the operator can evaluate the reliability and manually perform the remeasurement.

The reliability of the processing is obtained for each peak. Hence, if there is partially a peak or peaks with a low reliability, the peak or peaks may be preferentially measured in the subsequent measurement. For example, the measurement conditions may be modified so that the peak will neither undergo the ion disappearance caused by hiding in the shadow of the gate electrode nor overlap with any other peak.

In the mass analysis data processing method according to the first aspect of the present invention, in the course of performing the mass-to-charge ratio deduction step, a disappearance of a peak can be detected by checking that a peak, which is normally supposed to exist on a time-of-flight spectrum, does not exist. In addition, a mixing of a pseudo peak can be detected by checking that a peak, which is not normally supposed to exist on a time-of-flight spectrum, exists.

In particular, in an ion source which generates only a small amount of ions and has a poor reproducibility of generation of the ions, such as a matrix assisted laser desorption ionization (MALDI) source, the signal intensity is originally low. Therefore, not all ions may be observed on a time-of-flight spectrum after ions have completed many turns (which will be hereinafter referred to as the "unexplainable ion disappearance"). Actually, this sometimes occurs on a time-of-flight spectrum obtained with a single shot of laser beam. In addition, a pseudo ion may appear on the time-of-flight spectrum due to the contamination by an electric noise. In a processing such as the aforementioned one, for example, if the data have a peak or peaks missing and yet are consistent (i.e. with a high reliability) as a whole as compared to the zero-turn time-of-flight spectrum with a strong signal intensity, it can be determined that an "unexplainable ion disappearance has occurred." In general, in an MT-TOFMS, the signal intensity decreases as the number of turns of ions increases. Thus, the peak intensity of the zero-turn time-of-flight spectrum is the strongest and hence highly reliable. In addition, a peak which does not correspond to the zero-turn time-of-flight spectrum can be determined to be a pseudo peak due to a noise. Consequently, even if an unexplainable ion disappearance during flight and/or contamination by an electric noise occurs, an accurate mass spectrum can be constructed.

In the mass analysis data processing method according to the first aspect of the present invention, it is also possible that, in the course of performing the mass-to-charge ratio deduction step, an accidental overlapping of peaks is detected by checking that a plurality of peaks, corresponding to a plurality of peaks of interest, exist at the same position on another time-of-flight spectrum.

Furthermore, in the mass-to-charge ratio deduction step, by using a peak for which no accidental overlapping of peaks on a time-of-flight spectrum is detected, the signal intensity of the corresponding peak on the reconstructed mass spectrum may be obtained.

The intensity of the zero-turn time-of-flight spectrum can be basically used to accurately deduce the signal intensity. However, the mass resolving power of this time-of-flight spectrum is sometimes not sufficient and therefore a plurality of peaks in a time-of-flight spectrum obtained after ions have completed multiple turns may be united into one peak. Determining whether or not an accidental overlapping of peaks exists by the aforementioned processing makes it possible to find peaks which have resolved and untied from the overlapping state due to the increase in the mass resolving power after the ions have completed more turns along the loop orbit. Then, in accordance with the intensity ratio of the plurality of peaks, the peak intensity on the zero-turn time-of-flight spectrum can be distributed. This enables accurate deduction of the signal intensity as well as the mass-to-charge ratio, which makes it possible to construct a mass spectrum with accurate intensity information.

Furthermore, if an accidental overlapping of the peaks originating from ions having different mass-to-charge ratios is detected, the accidentally overlapping peaks may be excluded from the time-of-flight spectrum and the coincidence discrimination of a plurality of different candidates for the mass-to-charge ratio may be performed to determine the mass-to-charge ratio of the peak of interest. This further improves the accuracy of the deduction of the mass-to-charge ratio.

In the mass analysis data processing method according to the first aspect of the present invention and the mass spectrometer according to the second aspect of the present invention, even in the case where the number of components contained in a sample is large and hence many peaks exist on the time-of-flight spectrum obtained by a measurement, it is possible to create a mass spectrum in substantially real time with high mass resolving power, high mass accuracy, and high accuracy of the intensity from the time-of-flight spectrum by using a general-purpose personal computer. The present method or system also provides quantitative information indicating the reliability of the processing result. If the reliability is insufficient, the time-of-flight spectrum itself can be determined to be inadequate. Therefore, it is possible to easily and promptly take necessary measures, such as appropriately adjusting the ion ejection time from the loop orbit and then performing the measurement again or performing an additional measurement with different ejection times to increase the number of time-of-flight spectra to be referred to.

EXPLANATION OF THE NUMERALS

1 . . . Ion Source
2 . . . Gate Electrode
3 . . . Sector-Shaped Electrode
4 . . . Injection Path
5 . . . Loop Orbit
6 . . . Ejection Path
7 . . . Detector
8 . . . Data Processor

9 . . . Controller
10 . . . Injection/Ejection Voltage Applier
11 . . . Orbit Voltage Applier

DETAILED DESCRIPTION OF A PREFERRED EMBODIMENT

As previously described, the mass analysis data processing method according to the present invention uses the concept of the coincidence detection method to perform the assignment of peaks on the time-of-flight spectrum measured in the MT-TOFMS. The coincidence detection method is widely used in the field of radiation measurement. First, the concept of the coincident detection method is roughly explained with reference to FIG. 1.

Figure 1:
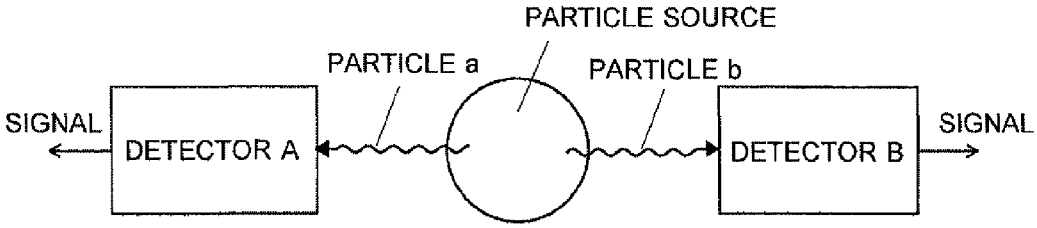
FIG. 1 is a conceptual diagram for explaining the coincidence detection method in the field of radiology.

Consider a physical phenomenon, as shown in FIG. 1, in which two particles a and b are simultaneously generated from a particle source and these particles a and b are received and detected by two detectors A and B, respectively. In general, in the coincidence detection method, when a detection signal is simultaneously detected in both the detectors A and B, it is determined that a significant coincidence event which probably involves simultaneous generation of the particles a and b has occurred. In other words, when a detection signal is generated in only one of the two detectors A and B, it is not determined that a significant coincidence event has occurred.

Suppose that the probability that a detection signal is generated in the detector A or B due to an accidental cause such as noise is 1% for each of them. The probability is given by the proportion of the detection signal to the operating time of the detector. Then, the probability that detection signals are simultaneously generated in both detectors A and B due to an accidental cause such as noise and an erroneous determination occurs that a significant coincidence event has occurred although it has not actually occurred, i.e., the probability that an accidental erroneous event (or an accidental), is $1\%\times1\%=10^{-4}$. That is, compared to the case where only one detector is provided, the probability of the accidental error is reduced to 1/100. If further multiple-coincidence is performed considering another particle c, the probability of an accidental error becomes $1\%\times1\%\times1\%=10^{-6}$; further reduction to 1/100. As just described, a main characteristic of the coincidence detection method is that "the probability that an error occurs is exponentially reduced as the number of multiple-coincidence is increased".

In the aforementioned coincidence detection method, the lower the probability of an accidental coincidence is, the higher the reliability of the result becomes. Therefore, the reciprocal of this probability of the occurrence of the accidental coincidence can be utilized as the index value for evaluating the reliability of the result. The probability of an accidental coincidence can be computed in the following manner. First, the average frequency that a noise is generated in a detector within unit time is denoted by Q. The second detector generates a signal in the form of a pulse with time width T. Then, the probability P of an event that the first detector accidentally detects a noise while a pulsed signal is generated during the time period from 0 through T in the second detector can be given by an exponential distribution. Therefore, to be exact, it is given by the following formula (1):

$$P=\int Qe^{-Qt}dt \tag{1}$$

where f denotes the integral from 0 to T. In the case where T is sufficiently small, the approximation of $e^{-Qt}\approx0$ holds. Hence, in place of formula (1), P=QT can be used. This approximation means that [the probability of the occurrence of an accidental coincident event]=[the frequency of the generation of a noise (in the first detector)]×[the pulse width (of the second detector)]. In addition, based on the same exponential distribution, an approximation that P=1 when QT>1 can be used. The aforementioned two approximations are also used for computing an after-mentioned probability.

Figure 2:
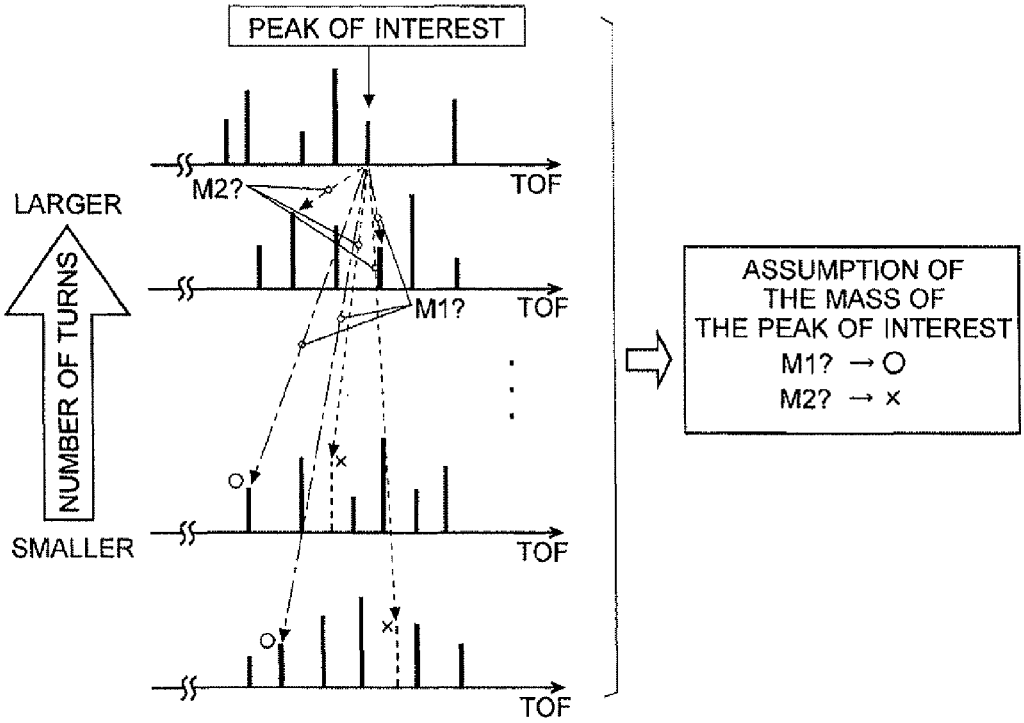
FIG. 2 is a diagram for explaining the principle of the mass analysis data processing method according to the present invention, which uses the concept of the coincidence detection method.
Figure 4:
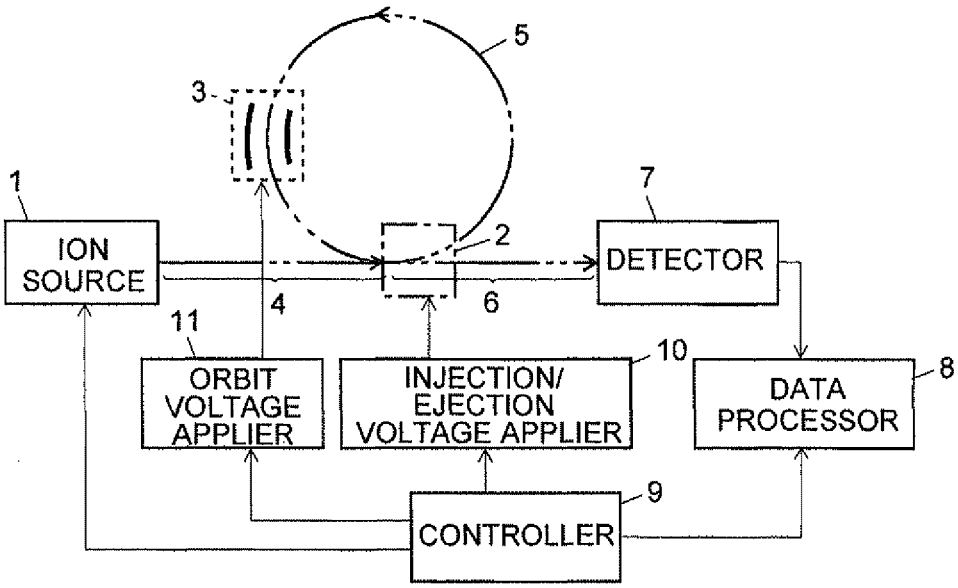
FIG. 4 is a schematic configuration diagram of an MT-TOFMS which is an embodiment of the mass spectrometer using the mass analysis data processing method according to the present invention.

In the mass analysis data processing method according to the present invention, the previously described concept of the coincidence detection method is used to determine the assignment of peaks on a time-of-flight spectrum measured in an MT-TOFMS, i.e. the mass-to-charge ratio of the ion corresponding to the peak. Suppose that, in an MT-TOFMS which is configured as schematically illustrated in FIG. 4, a plurality of different time-of-flight spectra of the same target sample have been obtained as illustrated in FIG. 2 by repeating the measurement while changing the timing, in a plurality of steps, for switching the voltage which is applied to the gate electrode 2 to eject ions turning along the loop orbit 5 from the orbit 5 and introduce the ions into the detector 7. In FIG. 2, the ion ejection time becomes longer (later) from bottom to top, and the overall number of turns of ions increases accordingly. However, the number of turns of the ions corresponding to the peaks appearing on one time-of-flight spectrum is not the same.

For each peak on any one of the plurality of time-of-flight spectra (e.g. the time-of-flight spectrum illustrated at the top in FIG. 2, which corresponds to the longest ejection time), the flight speed of the ion corresponding to that peak is computed using an assumed value of the mass-to-charge ratio of the ion. After that, the time position at which a peak relating to that ion will appear on another time-of-flight spectrum is computed from relevant parameters, such as the flight speed of the ion computed from the assumed value, the length of the orbit, and the ejection time of the ion. Next, it is checked whether or not a peak exists at the time position on the time-of-flight spectrum obtained by an actual measurement. For a given assumed value of the mass-to-charge ratio, if a corresponding peak exists on a plurality of different time-of-flight spectra (that is, in the case of multiple-coincidence), it is determined that the assumed value of the mass-to-charge ratio is correct. Conversely, if the corresponding peak cannot be found on a sufficient number of different spectra, it is determined that the assumed value of the mass-to-charge ration is incorrect.

In the example of FIG. 2, if M1 is assumed to be the mass-to-charge ratio of the ion relating to the peak of interest on a selected time-of-flight spectrum, corresponding peaks (the peaks marked with the white circles in the figure) exist on the other time-of-flight spectra. On the other hand, if M2 is assumed to be the mass-to-charge ratio of the ion relating to the same peak of interest, no corresponding peak exists on some of the other time-of-flight spectra (the dotted peaks marked with the x marks in the figure). That is, the probability of the existence of the peak is higher under the assumption that the mass-to-charge ratio is M1. Hence, it is determined that the assumption that the mass-to-charge ratio is M1 is correct, and it is concluded that the mass-to-charge ratio of the ion relating to the peak of interest is M1.

An amount corresponding to the previously described reliability of the deduction of the mass-to-charge ratio can be obtained by computing the accidental coincidence probability (or the probability of an erroneous coincidence) in an MT-TOFMS and calculating the reciprocal thereof. This quantification process of the reliability is explained hereinafter.

An accidental coincidence in an MT-TOFMS is not a complete noise as explained with reference to FIG. 1; in most cases, it is merely an overlapping of peaks having different mass-to-charge ratios, which is not a noise in a strict sense. However, when the ions concerned has a significantly large difference in the mass-to-charge ratio and hence a significantly large difference in the number of turn, the difference in the phase of the turn of the peaks originating from those ions will be sufficiently random, so that these peaks can be regarded as a noise for each other. Actually, the difference between the mass-to-charge ratios of the majority of the peaks and that of the peak of interest is sufficiently large, and the difference of the numbers of turn thereof is equal to or more than one. Under this assumption, the probability of an accidental coincidence of the result of an assignment of a peak in an MT-TOFMS is computed in the following manner.

Figure 3:
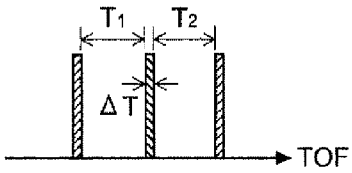
FIG. 3 is an explanation diagram for an example of a method for computing the probability of the occurrence of an accidental coincidence.

As previously described, the probability of the occurrence of an accidental coincident event is [the frequency of the generation of a noise]×[the pulse width]. If this is applied to a time-of-flight spectrum, the pulse width of the detector can be directly obtained by the time width of the measured peak. However, the frequency of the generation of a noise should be estimated. In one method, as the density of peaks around the peak of interest, the time differences $T_1$ and $T_2$ between the adjacent peaks are examined, as illustrated in FIG. 3. Then, the frequency Q that a noise (or an overlapping of peaks) occurs is defined by the following formula:

$$Q=1/\min(T_1,T_2)$$

where min(a, b) returns the smaller value between a and b. This is the maximum estimation and in most cases, the actual value is smaller than this estimation.

Then, the probability $P_i$ that the assignment of a peak of interest on any one of the time-of-flight spectra is accidental can be obtained by the following formula (2):

$$P_i=\Delta T/\min(T_i,T_2) \quad (2)$$

where ΔT is the peak time width of the peak of interest. The "probability of being accidental" obtained by this formula (2) is, to be more accurate, "the worst value (upper limit) of the probability of being accidental." In this specification, however, it is simply described as the "probability of being accidental."

The product P ($=P_1\times P_2\times \ldots \times P_n$), which is the product of the probabilities of being accidental with respect to the peak of interest on all the time-of-flight spectra, is computed in accordance with the following rules. The obtained P signifies the probability that the assignment result of the peak of interest is accidental.

(1) If $P_i>1$, then $P_i=1$. This is based on the approximation that P=1 when QT>1.

(2) As previously described, the ion disappearance caused by hiding in the shadow of the gate electrode 2 in ejecting ions from the loop orbit 5 is inevitable. However, the occurrence of this ion disappearance can be expected by calculation using an assumed mass. Hence, in the case where the occurrence of the ion disappearance is expected, $P_i=1$ is used so as to exclude this case from the determination of the existence or nonexistence of the peak.

(3) In the case where it is determined that a plurality of ions having a different mass-to-charge ratio contribute to the formation of the peak of interest (that is, there are multiple peaks accidentally overlapping each other), $P_i=1$ is used so as to determine that an accidental event has already occurred.

Next, a specific example of the mass analysis data processing method according to the present invention and an embodiment of the MT-TOFMS for performing this processing will be described with reference to FIGS. 4 through 7. FIG. 4 is a schematic configuration diagram of the MT-TOFMS of this embodiment.

An ion source 1 is an MALDI ion source for example, and supplies various kinds of ions with a predetermined amount of energy to collectively eject them. The ions travel through an injection path 4 and are introduced into a loop orbit 5 via a gate electrode 2. The loop orbit 5 is formed by an electric field created by applying a voltage from an orbit voltage applier 11 to each of plural pairs of sector-shaped electrodes 3 (only one pair is shown in the figure for simplicity). By the voltage applied from an injection/ejection voltage applier 10, the gate electrode 2 makes ions coming through the injection path 4 enter the loop orbit 5, or inversely, makes ions flying along the loop orbit 5 deviate from the orbit 5 to send them into an ejection path 6 leading to a detector 7. While ions are flying along the loop orbit 5, practically the gate electrode 2 can be considered to be nonexistent.

The detector 7 detects ions which sequentially arrive as time progresses, and produces an intensity signal in accordance with the amount of ions. This signal is sent to a data processor 8. Although not shown, the data processor 8 digitizes the detection signal received from the detector 7 and memorizes the digital data as time-of-flight spectrum data. The data processor 8 then processes this time-of-flight spectrum data in an after-mentioned manner to construct a mass spectrum. A controller 9 controls each unit to obtain a required number of time-of-flight spectrum data set for a target sample. Many functions of the data processor 8 and the controller 9 are achieved by running a dedicated processing/control software program previously installed on a general-purpose personal computer.

Figure 5:
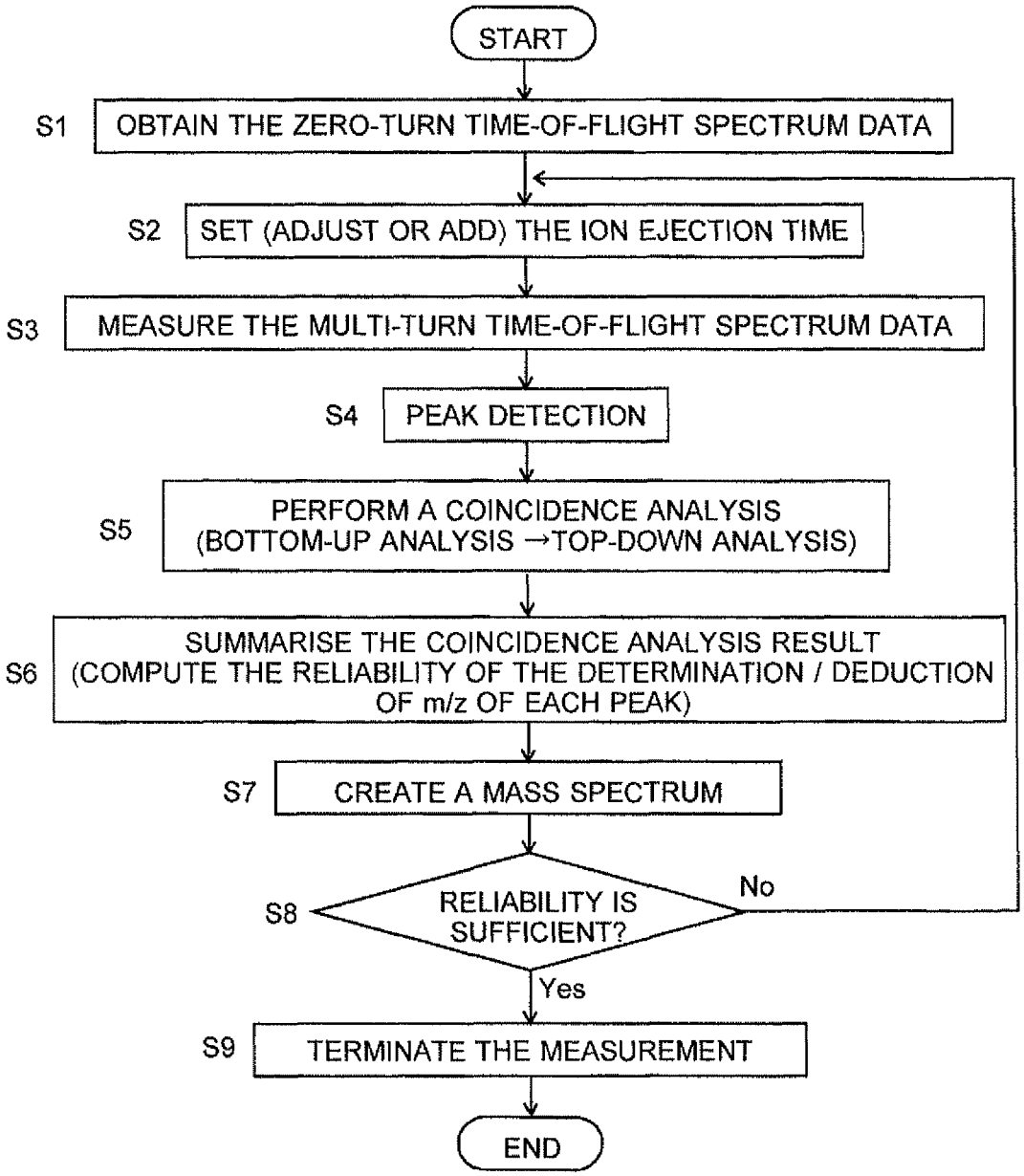
FIG. 5 is a flowchart showing a procedure of the mass analysis data processing method according to an embodiment of the present invention.
Figure 6:
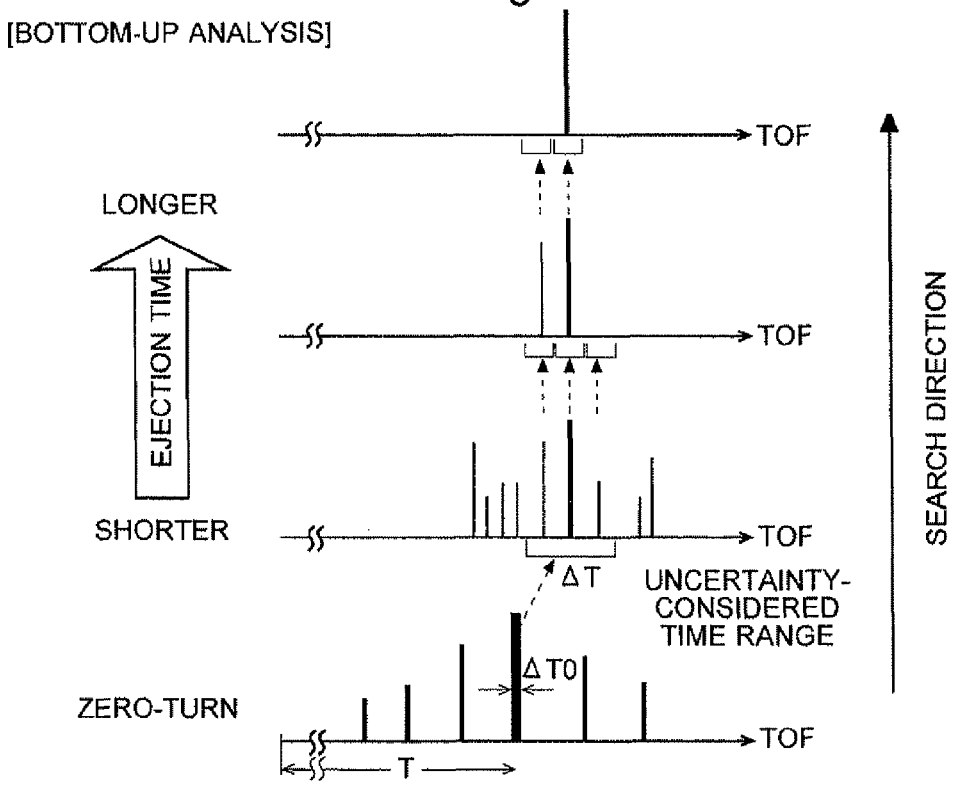
FIG. 6 is an explanation diagram for the coincidence analysis used in the mass analysis data processing method illustrated in FIG. 5.
Figure 7:
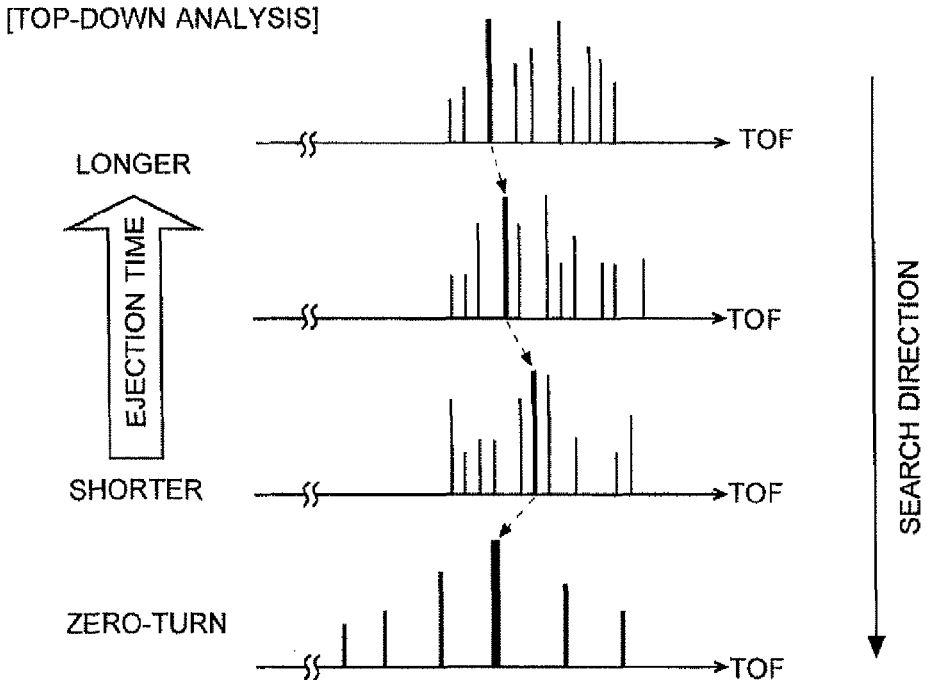
FIG. 7 is an explanation diagram for the coincidence analysis used in the mass analysis data processing method illustrated in FIG. 5.

FIG. 5 is a flowchart showing a data processing and control in obtaining a mass spectrum of the target sample in the MT-TOFMS of the present embodiment. FIG. 6 is a schematic diagram showing a procedure of a bottom-up analysis, which is a part of the coincidence analysis in FIG. 5. FIG. 7 is a schematic diagram showing a procedure of a top-down analysis whish is also a part of the coincidence analysis. In both FIGS. 6 and 7, as in FIG. 2, the ejection time becomes longer, i.e. their mass resolving power becomes higher, from bottom to top of the time-of-flight spectra.

When a measurement is initiated, first, under the control of the controller 9, ions ejected from the ion source 1 are not introduced into the loop orbit 5 but made to directly arrive at the detector 7. Then the data processor 8 obtains zero-turn time-of-flight spectrum data (Step S1). In this case, the flight distance of the ions is the sum of length La of the injection path 4 and length Lb of the ejection path 6. Since the overtaking of ions does not occur in obtaining this zero-turn time-of-flight spectrum data, peaks appear in the order of mass-to-charge ratio on the time-of-flight spectrum. However, since the mass resolving power is low, peaks having a similar mass-to-charge ratio are insufficiently resolved each other and observed as one broad peak.

Next, the controller 9 sets a plurality of ion ejection times for performing multi-turn measurements (Step S2). The mass resolving power depends on the flight distance, i.e. the number of turns. Hence, the approximate value of the longest ejection time can be obtained in accordance with the mass-to-charge ratio range of the measurement target ions and the desired mass resolving power. Based on this, a plurality of ejection times are appropriately set, including the aforementioned longest ejection time and the other ejection times shorter than that. Meanwhile, the approximate time of flight of various kinds of components contained in the target sample can be estimated from the zero-turn time-of-flight spectrum data obtained in Step S1. Hence, it is preferable that the ejection times be optimized based on the estimated times of flight so as to minimize the number of peaks which disappear as a result of hiding in the shadow of the gate electrode 2. After the ejection times are selected, under the control of the controller 9, the second and subsequent measurements of the target sample are performed under the selected conditions to obtain multi-turn time-of-flight spectrum data (Step S3). In the present embodiment, the point in time when ions are ejected from the ion source 1 is defined as the zero point for the ion ejection time. Accordingly, the ion ejection time is the sum of the period of time for the ions pass through the injection path 4, and the period of time for the ions to turn around the loop orbit 5 a certain number of times until they are ejected from the orbit 5.

After plural sets of multi-turn time-of-flight spectrum data are collected, peak detection is performed to these data, including the zero-turn time-of-flight spectrum data, to obtain the intensity and the time of flight of each peak for every time-of-flight spectrum (Step S4). In the case where a peak has a large time width, the time width of the peak and the middle value thereof may be obtained as the time-of-flight data. Alternatively, both the starting time and the ending time of that peak may be obtained as the time-of-flight data.

After that, the data processor 8 performs a coincidence analysis processing based on the aforementioned principle (Step S5). In the explanation of the principle with reference to FIG. 2, an assumed value of the mass-to-charge ratio was given to a peak appearing on the time-of-flight spectrum for the longest ion ejection time and the existence or nonexistence of a corresponding peak on other time-of-flight spectra was judged. In practice, however, a time-of-flight spectrum of ions, which have completed many turns, contains many peaks having insufficient signal intensities due to a gradual decrease in the number of ions during their flight. Therefore, it is difficult to start the deduction from the time-of-flight spectrum for the longest ion ejection time. On the other hand, in the zero-turn time-of-flight spectrum, although the mass resolving power is low, the signal intensity of the peaks is sufficiently large and there occurs no ion disappearance caused by hiding in the shadow of the gate electrode 2. Hence, it can be supposed that all ions are reflected in the spectrum data. Therefore, in this embodiment, a bottom-up analysis starting from the zero-turn time-of-flight spectrum is first performed to search for candidates for the corresponding peak, and then a top-down analysis starting from the time-of-flight spectrum with the highest mass resolving power is performed to stochastically discriminate the candidates for the corresponding peak.

In the bottom-up analysis, which starts from the zero-turn time-of-flight spectrum and goes through the other spectra in ascending order of their ion ejection time, the time range of an uncertainty width ΔT which is determined from the mass resolving power R ($m/\Delta m=T/2\Delta T$) is searched to determine whether or not a peak exists within the time range.

For example, as for one peak on the zero-turn time-of-flight spectrum, the length of its flight path is La+Lb. From the time of flight of this peak (e.g. the time width and the middle value) and the length of its flight-path, the flight speed v1 of the ion corresponding to the peak can be computed with a certain width (or the uncertainty width). The time of flight T1 for this ion to pass through the injection path 4 can also be computed with a certain width. The ion ejection time T2 at which a multi-turn time-of-flight spectrum has been obtained is expressed by the following formula (3):

$$T2=T1+(Lc\cdot N)/v1 \quad (3),$$

where Lc is the circumferential length of the loop orbit 5, and N is the number of turns. Since T2 and Lc are known and v1 and T1 are each determined with a predetermined width as previously described, the number of turns can be deduced from formula (3).

Thus the time range ΔT, where a peak originating from the ion of the same kind of the peak of interest on the zero-turn time-of-flight spectrum is likely to appear, can be determined on a multi-turn time-of-flight spectrum. As the number of turns increases, the time of flight T also increases. Therefore, as illustrated in FIG. 6, for a peak having a certain time width ΔT0 on the zero-turn time-of-flight spectrum, the time range ΔT, in which the corresponding peak is likely to appear, becomes wider in multi-turn time-of-flight spectra. All the peaks existing in the time range ΔT are selected as the candidates for the corresponding peak. The flight speed of ions and other values are computed again as previously described for each of all the candidate peaks, and the time range in which the peak originating from the ion of the same kind is likely to appear is set on the multi-turn time-of-flight spectrum for a longer ion ejection time. This process is repeated and eventually the time range is set on the time-of-flight spectrum for the longest ejection time, i.e. with the highest temporal resolution (consequently, the highest mass resolving power), and a peak or peaks existing in the time range are extracted. Hereinafter, this spectrum will be called the "maximum-turn-number time-of-flight spectrum".

Of course, the number of turns computed with formula (3) is required to be expressed in an integer. In the case where the number of turns is indeterminate, the occurrence of ion disappearance caused by hiding in the shadow of the gate electrode 2 is expected. In such a case, it is not possible to find a corresponding peak on the time-of-flight spectrum, Therefore, the determination of existence or nonexistence of the corresponding peak on that time-of-flight spectrum is not performed and the process skips to the time-of-flight spectrum for a longer ion ejection time. Even in the case where an ion disappearance caused by hiding in the shadow of the gate electrode 2 is not expected, if no corresponding peak is found, the process proceeds to the time-of-flight spectrum for a longer ion ejection time, because an unintended ion disappearance may have occurred. That is, when multi-turn time-of-flight spectra are individually and sequentially checked for the existence of a corresponding peak in the bottom-up analysis, even if no corresponding peak is found during the analysis, the process is repeated until the maximum-turn-number time-of-flight spectrum is reached.

The result of the analysis, or all information obtained in the course of the analysis is memorized for each of the peaks on the maximum-turn-number time-of-flight spectrum. This information includes the number of corresponding peaks (in the set time range) found in the search path to reach the maximum-turn-number time-of-flight spectrum, the time of flight (the number of turns, or the mass-to-charge ratio) of each peak, the correspondence relationship with the peak on the zero-turn time-of-flight spectrum, and other data. In the case where the peak or peaks concerned have disappeared on the maximum-turn-number time-of-flight spectrum, the corresponding peak or peaks on the time-of-flight spectrum for one-step shorter ion ejection time may be used. As a result of the aforementioned process, one or more peaks, which correspond to one peak of interest on the zero-turn time-of-flight spectrum, are obtained on the maximum-turn-number time-of-flight spectrum, and the mass-to-charge ratio of each of the peaks is obtained. The same processing is performed for all peaks of interest on the zero-turn time-of-flight spectrum. A plurality of peaks corresponding to different peaks of interest on the zero-turn time-of-flight spectrum may overlap each other at the same point in time on the maximum-turn-number time-of-flight spectrum. In this case, the number of the candidates for the mass-to-charge ratio on the maximum-turn-number time-of-flight spectrum is more than one.

In the bottom-up analysis shown in FIG. 6, the determination of the existence or nonexistence of a peak is performed in the time range which is set based on the time-of-flight spectrum located immediately below. However, the determination of the correspondence of the peak on all the multi-turn time-of-flight spectra may be performed based on the zero-turn time-of-flight spectrum. Although this naturally increases the number of candidate values assumed for the mass-to-charge ratio and the time required for the analysis is increased accordingly, it is very significant in that the basic procedure of the analysis will be considerably simplified. The coincidence analysis tends to be complicated in handling unexpected situations, such as an unexplainable ion disappearance or the splitting of peaks caused by an improvement in the mass resolving power. The bottom-up analysis based on the zero-turn time-of-flight spectrum deals with the largest number of candidate values assumed for the mass-to-charge ratio and thereby eliminates the possibility of overlooking important peaks.

After the bottom-up analysis is finished, a top-down analysis is performed, starting from each peak on the maximum-turn-number time-of-flight spectrum and following the peaks on the time-of-flight spectra for shorter ion ejection times. Since the temporal resolution decreases in this direction, an uncertainty width does not exist at the time position obtained from the mass-to-charge ratio. Hence, unlike the bottom-up analysis, no splitting of the peak occurs in the top-down analysis, and as illustrated in FIG. 7, basically it is possible to sequentially follow one series of peaks (unless an ion disappearance occurs). In the case where a plurality of candidates for the mass-to-charge ratio are listed for one peak on the maximum-turn-number time-of-flight spectrum, a plurality of search paths are formed starting from that one peak. In this case, an ion disappearance should be handled as in the case of the bottom-up analysis. Also, all the analysis results should be memorized as in the bottom-up analysis.

After the coincidence analysis relating to all peaks of interest is finished, then the analysis result is summarized (Step S6). "Summarizing" as used herein refers to deducing the most probable mass-to-charge ratio for each peak by referring to all the analysis results, quantifying the reliability of the deduction, deducing the signal intensity for each mass-to-charge ratio by using the result of the determination of the existence of an overlapping of peaks, and other computations. As previously described, the reliability of the deduction is obtained by computing each probability of being accidental on all the time-of-flight spectra, and multiplying the probabilities. In addition, the occurrence of an ion disappearance and the existence of noise are determined in accordance with the following rules.

(1) The corresponding peak may not be found on some time-of-flight spectra. In this case, if a consistent result as a whole is obtained in the coincidence analysis, it is determined that an unexplainable ion disappearance has occurred at the point where the corresponding peak is missing.

(2) To obtain the mass-to-charge ratio with a high resolving power, it is preferable to use a time-of-flight spectrum having the highest possible resolving power (or the longest ion ejection time). However, if an accidental peak overlapping occurs (i.e. if a plurality of mass-to-charge ratios are associated with one peak) on the time-of-flight spectrum, the peak position is shifted due to the peak overlapping. Hence, it is inappropriate to obtain the mass-to-charge ratio from this peak. Therefore, in order to obtain the mass-to-charge ratio with a high resolving power and accuracy, for a peak that does not overlap any other peak on the maximum-turn-number time-of-flight spectrum, the mass-to-charge ratio is obtained from the time position of the peak, and for a peak that overlaps another peak on the maximum-turn-number time-of-flight spectrum, the mass-to-charge ratio is obtained from the time position of the peak that does not overlap other peak on the time-of-flight spectrum with the second highest mass resolving power (i.e. with a shorter ejection time).

(3) A peak to which no ion is assigned is determined to be a noise peak originating from an electric noise or other sources.

The signal intensity can be determined in accordance with the following rules.

(1) If it has been eventually found that a certain peak on the zero-turn time-of-flight spectrum is not associated with a plurality of peaks (i.e. if the peak is associated with only one peak), the signal intensity of this peak on the zero-turn time-of-flight spectrum is selected as the signal intensity of the corresponding mass-to-charge ratio.

(2) In the case where one peak on the zero-turn time-of-flight spectrum has been found to be associated with a plurality of peaks, it can be determined that the aforementioned peak on the zero-turn time-of-flight spectrum is formed by a plurality of ions with different mass-to-charge ratios which are mixed together due to the low mass resolving power. Given this result, the signal intensity ratio of each peak is obtained on a multi-turn time-of-flight spectrum where none of the peaks generated by the splitting of the peak overlap each other, and the signal intensity of the aforementioned peak on the zero-turn time-of-flight spectrum is distributed to the plurality of peaks according to their signal intensity ratio.

As just described, the mass-to-charge ratio and the signal intensity of each peak can be determined. Using this computational result, a mass spectrum is constructed (Step S7). Although the reliability of the deduction is obtained for each peak (or mass-to-charge ratio), if the relationship between the mass-to-charge ratio of an actually existing ion and the originally set ion ejection time is not appropriate, the reliability can significantly deteriorate. Given this factor, for example, a threshold of the reliability may be set in advance. If there is a peak whose reliability is less than this threshold ("No" in Step S8), the process returns to Step S2, and the controller 9 changes the ion ejection time or adds a new ion ejection time. In this case, since only the peak or peaks with a low reliability should be analyzed again, it is preferable, for example, to appropriately change the ion ejection time so that the peaks with a low reliability do not hide in the shadow of the gate electrode 2. After the change or addition of the ion ejection time as just described, the same sample is measured again to obtain multi-turn time-of-flight spectra. Then, the previously described analysis is performed.

When the reliabilities of all the peaks are equal to or higher than the threshold, the measurement is terminated (Step S9), and the created mass spectrum is provided as the measurement result. Alternatively, for example, even in the case where the reliabilities of all the peaks do not exceed the threshold, when a predetermined computational time has elapsed, the process may be aborted and the mass spectra obtained by then may be shown to the operator. Showing the mass spectra with their reliability indices enables the operator to know which peak is not reliable.

The effectiveness of the data processing according to the present invention has been verified by a simulation, the result of which is presented hereinafter. For this simulation, 202 ions were prepared, where 201 ions had a mass-to-charge ratio from 1000 to 1200 [Da] at intervals of 1 [Da] and each had the signal intensity from 100 to 200 at 0.5 steps, respectively. The remaining one ion, which was prepared as an ion peak of an adjacent mass-to-charge ratio, had a mass-to-charge ratio of 1050.05 [Da] with a signal intensity of 50. To simulate the occurrence of an unexplainable ion disappearance, it was assumed that the $60^{th}$ peak on every time-of-flight spectrum would disappear. The mixture of an electrical noise was also simulated by intentionally inserting a peak having a signal intensity of 50 at the position of 1005.5+10·n [Da] on the $n^{th}$ multi-turn time-of-flight spectrum. The lengths of the flight path of ions were: La=0.98 [m], Lb=0.53 [m], and Lc=0.97 [m]. The peak width was 10 [ns], and the ion-acceleration voltage was 5.28 [kV]. It was assumed that the ion disappearance caused by hiding in the shadow of the gate electrode 2 would occur in a section covering 10% of the loop-orbit length.

Figure 8A:
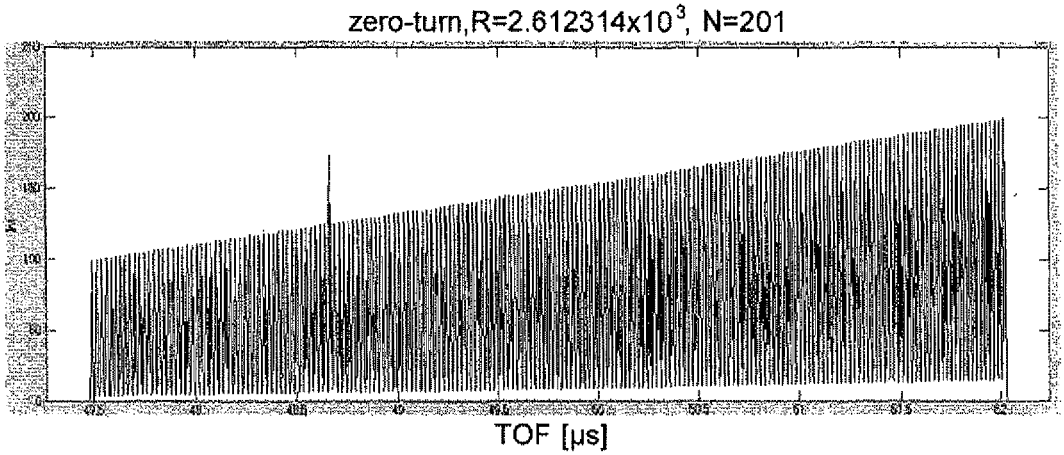
FIGS. 8A and 8B show an example of a time-of-flight spectrum obtained by a simulation computation.
Figure 8B:
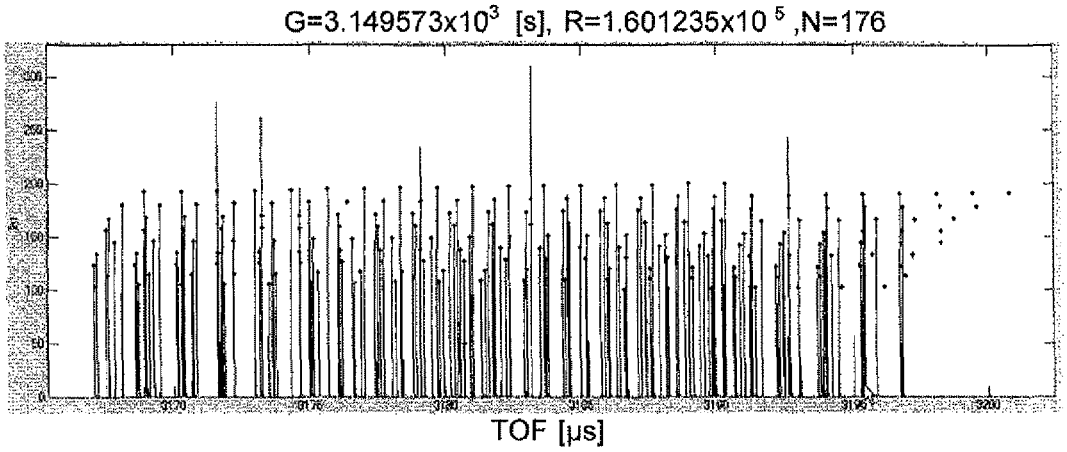

FIG. 8A shows the zero-turn time-of-flight spectrum obtained by the simulation performed based on the aforementioned parameters. This figure shows that peaks having close masses are not separated due to an insufficient mass resolving power. "R" and "N" on top of FIG. 8 respectively indicate the mass resolving power and the number of peaks detected by peak detection. FIG. 8B is a time-of-flight spectrum obtained when the ion ejection time was set to be 3.14957 [msec]. The points in the figure indicate the original peak positions and the signal intensities. With such a large number of peaks, accidental overlapping of the peaks is inevitable. The peaks higher than the points indicate that their signal intensity was increased due to the accidental overlapping of the peaks. The independent points indicate that the peaks corresponding to those points were lost due to an ion disappearance caused by hiding in the shadow of the gate electrode 2 or an unexplainable ion disappearance. Thus, as a result of the peak detection, the number of peaks was reduced to 176 including additional noise peak.

Seven time-of-flight spectra having a mutually different ion ejection time were prepared, including the time-of-flight spectrum as shown in FIGS. 8A and 8B, and a mass spectrum was created based on the data processing method as previously described. The result is shown in FIGS. 9A through 9C.

Figure 9A:
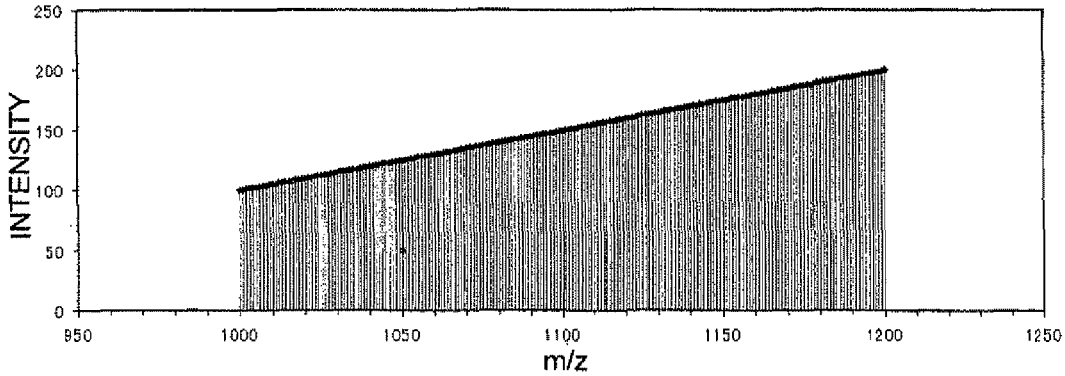
FIG. 9A is a mass spectrum created from the time-of-flight spectrum illustrated in FIG. 8.
Figure 9B:
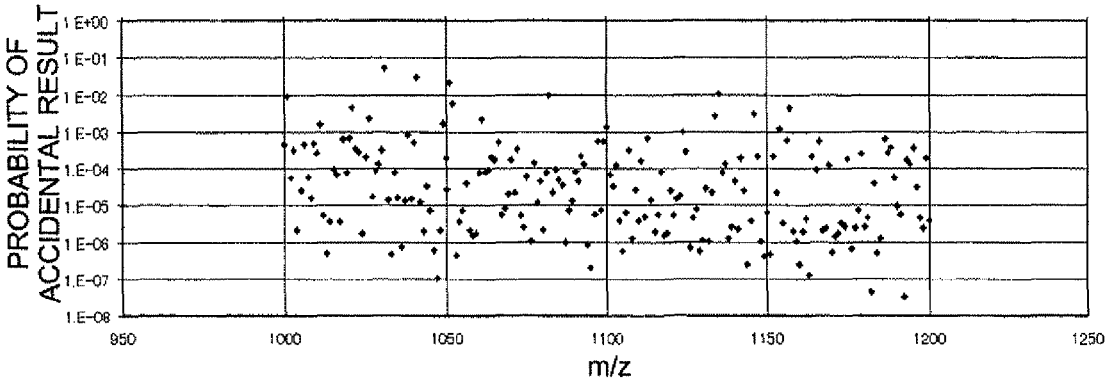
FIG. 9B is a diagram showing the probability that the analysis result of each peak is accidentally obtained.

FIG. 9A shows the created mass spectrum. This figure shows that the signal intensities of all the peaks were correctly reproduced, including the peaks having close mass-to-charge ratios. FIG. 9B shows the probability (upper limit) that the analysis result of each peak accidentally occurs with respect to each mass-to-charge ratio. For most peaks, the probability that the analysis result accidentally occurs is less than 1/100, showing that the analysis result is highly reliable.

Figure 9C:
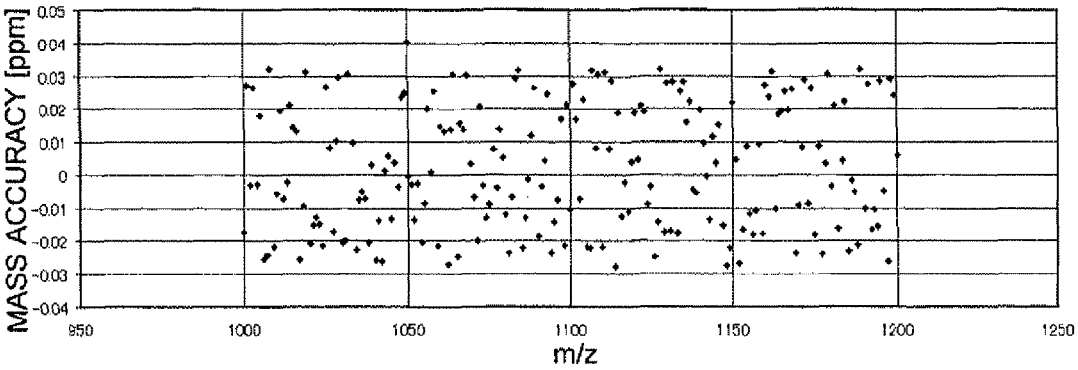
FIG. 9C is a diagram showing the mass accuracy of the mass spectrum.

FIG. 9C shows the mass accuracy of the created mass spectrum. The mass accuracy is within a range of ±0.04 [ppm]. The mass error shown are attributable to the peak detection. The personal computer used for the analysis was a general-purpose one (Genuine Intel CPU 2140@1.6 GHz 1.2 GHz 504 MB RAM). The time required to complete the analysis was 360 [ms], which is short enough for real-time measurement.

On examining the analysis result, it was found that with the previously described determination method, an unexplainable ion disappearance and a mixture of an electric noise, as well as the ion disappearance caused by falling under the shade of the gate electrode 2 and the overlapping of peaks were correctly recognized on each time-of-flight spectrum.

As described thus far, with the mass analysis data processing method according to the present invention, an accurate mass spectrum with a high resolving power can be created in substantially real-time from time-of-flight spectra collected by an MT-TOFMS by using a general-purpose personal computer.

It should be noted that the embodiments described thus far are mere examples of the present invention, and it is a matter of course that any modification, adjustment, or addition made within the spirit of the present invention is also included in the scope of the claims of the present application.

What is claimed is:

1. A mass analysis data processing method for processing data collected by a multi-turn time-of-flight mass spectrometer including: an ion source for ejecting ions to be analyzed in a pulsed fashion; a loop orbit unit for making ions ejected from the ion source fly multiple times along a substantially same orbit; and a detector for detecting ions which have flown in the loop orbit unit comprising:

creating a plurality of time-of-flight spectra of a same sample by changing, in stages, a timing of ejecting ions from the loop orbit so as to direct the ions from the loop orbit unit to the detector, determining a mass-to-charge ratio of an ion corresponding to a peak of interest on one time-of-flight spectrum selected from the aforementioned plurality of time-of-flight spectra, based on coincidence discrimination of a plurality of assumed values of the mass-to-charge ratio, wherein each coincidence discrimination is obtained by performing, for each of two or more of the aforementioned plurality of time-of-flight spectra other than the aforementioned one time-of-flight spectrum, a process including estimating flight times of the ion corresponding to the peak of interest on the time-of-flight spectrum by assuming values of the mass-to-charge ratio, and checking whether or not a peak exists at the estimated flight time on an actually obtained time-of-flight spectrum; and deducing, for each of the aforementioned two or more time-of-flight spectra, a probability that the coincidence in the time position of the peak of interest on the other time-of-flight spectrum accidentally occurs in determining the mass-to-charge ratio, and computing a quantitative value representing a degree of reliability of the processing performed in determining the mass-to-charge ratio from the deduced values of the probability for the plurality of other time-of-flight spectra.

2. The mass analysis data processing method according to claim 1, wherein in deducing a probability, a probability that a coincidence of the time position of the peak with the time position of the peak of interest on the time-of-flight spectrum accidentally occurs is deduced based on information on adjacent peaks on a time axis.

3. The mass analysis data processing method according to claim 1, wherein the reliability obtained is checked and in the case where the reliability is low, a different time-of-flight spectrum is further obtained after adjusting the timing or adding a timing for ejecting the ions from the loop orbit.

4. The mass analysis data processing method according to claim 1, wherein in determining the mass-to-charge ratio, a disappearance of a peak is detected by checking that a peak which is normally supposed to exist on a time-of-flight spectrum does not exist.

5. The mass analysis data processing method according to claim 1, wherein in determining the mass-to-charge ratio, a mixing of a pseudo peak is detected by checking that a peak which is not normally supposed to exist on a time-of-flight spectrum exists.

6. The mass analysis data processing method according to claim 1, wherein in determining the mass-to-charge ratio, an overlapping of peaks is detected by checking that a plurality of peaks on another time-of-flight spectrum corresponding to a plurality of peaks of interest exist at a same time position.

7. The mass analysis data processing method according to claim 6, wherein in determining the mass-to-charge ratio, the detected overlapping peaks are excluded, coincidence discrimination of a plurality of different candidates for the mass-to-charge ratio are performed, and the mass-to-charge ratio of the peak of interest is determined.

8. The mass analysis data processing method according to claim 7, wherein in determining the mass-to-charge ratio, a signal intensity of the corresponding peak on the mass spectrum is obtained by using a peak for which no overlapping has been detected on the time-of-flight spectrum.

9. A time-of-flight mass spectrometer comprising:

an ion source for ejecting ions to be analyzed in a pulsed fashion;

a loop orbit unit for making ions ejected from the ion source fly multiple times along a substantially same orbit;

a detector for detecting ions which have flown in the loop orbit unit;

a data processor for creating a mass spectrum based on a plurality of time-of-flight spectra of a same sample obtained by changing, in stages, a timing of ejecting ions from the loop orbit so as to direct the ions from the loop orbit unit to the detector, wherein the data processor has a mass-to-charge ratio deduction member for determining a mass-to-charge ratio of an ion corresponding to a peak of interest on one time-of-flight spectrum selected from the aforementioned plurality of time-of-flight spectra, based on coincidence discrimination of a plurality of assumed values of the mass-to-charge ratio, wherein each coincidence discrimination is obtained by performing, for each of two or more of the aforementioned plurality of time-of-flight spectra other than the aforementioned one time-of-flight spectrum, a process including estimating flight times of the ion corresponding to the peak of interest on the time-of-flight spectrum by assuming values of the mass-to-charge ratio, and checking whether or not a peak exists at the estimated flight time on an actually obtained time-of-flight spectrum; and a reliability computing member for deducing, for each of the aforementioned two or more time-of-flight spectra, a probability that the coincidence in the time position of the peak of interest on the other time-of-flight spectrum accidentally occurs in the process performed by the mass-to-charge ratio deduction member, and for computing a quantitative value representing a degree of reliability of the processing performed in determining the mass-to-charge ratio from the deduced values of the probability for the plurality of other time-of-flight spectra.

* * * * *